United States Patent [19]

Martin

[11] 4,307,838

[45] Dec. 29, 1981

[54] FUEL INJECTOR

[75] Inventor: Barrie J. Martin, Shenfield, England

[73] Assignee: Plessey Handel und Investments AG, Zug, Switzerland

[21] Appl. No.: 51,185

[22] Filed: Jun. 22, 1979

[30] Foreign Application Priority Data

Jun. 24, 1978 [GB] United Kingdom ..... 27817/78

[51] Int. Cl.[3] ..... F02D 5/00

[52] U.S. Cl. ..... 239/102; 239/533.4; 251/285

[58] Field of Search ..... 123/32 JT, 32 JV; 251/285; 261/DIG. 48; 239/95, 102, 533.2–533.12

[56] References Cited

U.S. PATENT DOCUMENTS 3,830,433 8/1974 Miyake et al. ..... 239/533.5

3,949,938 4/1976 Goodinge ..... 239/102

*Primary Examiner*—Andres Kashnikow

*Attorney, Agent, or Firm*—Fleit & Jacobson

[57] ABSTRACT

An injector for injecting fuel for an engine, which injector comprises a nozzle, a fuel injection orifice in the nozzle, a valve for closing the orifice, a vibratory device for vibrating the nozzle to cause the valve to move away from the orifice to allow fuel to be injected, and a stop device for limiting the travel of the valve away from the orifice, the stop device being movable whereby during use of the fuel injector the injected fuel for the engine can be varied to suit the engine requirements at any given time by moving the stop device so as to control the travel of the valve injection rate through the orifice.

9 Claims, 9 Drawing Figures

FUEL INJECTOR

This invention relates to an injector for injecting fuel into an engine. This invention also relates to a fuel injection system employing the injector.

Injectors for injecting fuel into an engine are well known. One type of known fuel injector comprises a nozzle, a fuel injection orifice in the nozzle, valve obturator means for closing the orifice, vibratory means for vibrating the nozzle to cause the valve obturator means to move away from the orifice to allow fuel to be injected and stop means for limiting the travel of the valve obturator means away from the orifice. In this known type of fuel injector, the stop means was found to be desirable because if the travel of the valve obturator means away from the orifice was not limited, the valve obturator means tended to move so far away from the orifice that it could not return speedily to the orifice when the vibratory means stop vibrating the nozzle. In the injection of fuel for an engine, very precise fuel injection requirements have to be met and it is highly desirable that very precise control be had over the valve obturator means whereby it can very quickly return to its orifice to shut off fuel injection to the orifice.

The known fuel injectors can be employed in fuel injection systems wherein one injector is present per engine cylinder so that each injector injects fuel into a separate engine cylinder. This type of injection system generally gives a vehicle much better driveability, engine response and power output, but it has the disadvantage of being expensive. It is cheaper and therefore often preferred to use the injectors such that a single injector or sometimes more than one injector injects fuel into an air duct leading to an engine, the air duct supplying all the engine cylinders. In either instance, it is still extremely desirable to have extremely precise control over the travel of the valve obturator means.

Where a single injector is used in an air duct to supply fuel to several engine cylinders, the flow rate from that injector must be much greater than when an injector fuels only one cylinder. This means that a high flow rate injector must have its stop positioned well back from the injector orifice so as to give a long travel of the valve obturator means and hence high fuel flow. In order to obtain the very low flows required during light engine loads and at engine idle conditions, the injector must be pulsed on for short periods, for example less than 1.5 m. sec. duration pulse width. It is a fact that the longer the travel of the valve obturator means then the less control there is over the movement of the valve obturator means during these short pulse widths and hence the less control there is over the fuel flow produced during that pulse duration, and this at an operating condition of the engine when very precise fuel control is essential.

The present invention provides an injector for injecting fuel for an engine, which injector comprises a nozzle, a fuel injection orifice in the nozzle, valve obturator means for closing the orifice, vibratory means for vibrating the nozzle to cause the valve obturator means to move away from the orifice to allow fuel to be injected, and stop means for limiting the travel of the valve obturator means away from the orifice, the stop means being movable whereby during use of the fuel injector the injected fuel for the engine can be varied to suit the engine requirements at any given time by moving the stop means to control the travel of the valve obturator means away from the orifice to that giving the desired fuel injection rate through the orifice.

With an injector employing a fixed stop means, the preferred flow control variables are pulse width and pulse repetition frequency. With the injection of the present invention which employs the variable stop means, an additional variable is provided. This advantageously enables the low flow rate required at engine idle and light load conditions to be obtained with a high flow rate injector by reducing the travel of the valve obturator means and retaining preferred longer pulse widths rather than using short pulse widths approaching the lower limit of the injector. At maximum flow rates required under heavy engine loads and high speeds, the variable stop means can be moved away from the orifice giving longer travel of the valve obturator means and hence the required maximum fuel flow rate for a given duty cycle of the injector.

Preferably, the valve obturator means is a ball. However, if desired, other types of valve obturator means such for example as an elongate plug may be employed.

Preferably, the vibratory means is a piezoelectric device. If desired, however, other vibratory means such for example, as a magnetostrictive device can be employed. The piezoelectric device will usually be electrically vibrated at ultrasonic frequencies.

Preferably, the stop means is substantially continuously variable between its minimum and maximum positions of movement. Alternatively, the stop means may be movable only directly from a first position to a second position and in this case there will be no continuously variable adjustment. When the stop means is movable only directly from a first position to a second position, one position may correspond to engine idle conditions and the other position may correspond to other engine load conditions up to engine full throttle conditions.

Advantageously, the valve obturator means moves in a housing. The housing may be provided with slots, whereby fuel to be injected is caused in use of the injector to pass through the slots and into the housing wherein it is caused to swirl by virtue of its passage through the slots.

The housing is preferably provided with an aperture at the position to which the valve obturator means tends to travel when it is vibrated away from the orifice, the aperture enabling fuel to pass therethrough and force the valve obturator means back to the orifice when the vibratory means ceases to vibrate the nozzle.

The rear face of the housing may act as the stop means. Alternatively, the stop means may be constituted by a single abuttment, for example on the end of a rod.

Preferably the stop means is attached to a rod which passes longitudinally through the injector.

The rod may be provided with some form of adjustment means whereby it can be moved. Thus, for example, the rod may be provided with a threaded section which projects out of the nozzle, whereby the rod is adapted to be screwed in and out of the nozzle to vary the position of the stop means.

The rod may co-operate with a cam, the rod being biased against the cam whereby the rod is adapted to be moved in and out of the nozzle to vary the position of the stop means. Alternatively, the rod may co-operate with a vacuum device, whereby the rod is adapted to be moved in and out of the nozzle to vary the position of the stop means. Further, the rod may co-operate with a torque motor which is adapted to move the rod in and out of the nozzle to vary the position of the stop means. The cam, vacuum device and the torque motor are preferably adapted to move the rod and therefore the stop means substantially continuously to give substantially continuous fine adjustment. Other devices could however be employed for moving the rod and the stop means from the first position suitable for low engine fuel requirements to a second position suitable for higher engine fuel requirements.

The present invention also includes a fuel injection system whenever including an injector of the invention.

Preferably, the fuel injection system comprises electrical means for sensing various engine parameters and for adjusting at least one of the stop means, the width of the pulses used to energise the vibratory means, and the number of pulses per unit time used to energise the vibratory means. The sensed engine parameters may be engine temperature, the amount of oxygen in the engine exhaust, and engine speed.

Embodiments of the invention will now be described solely by way of example and with reference to the accompanying drawings in which.

Figure 1:
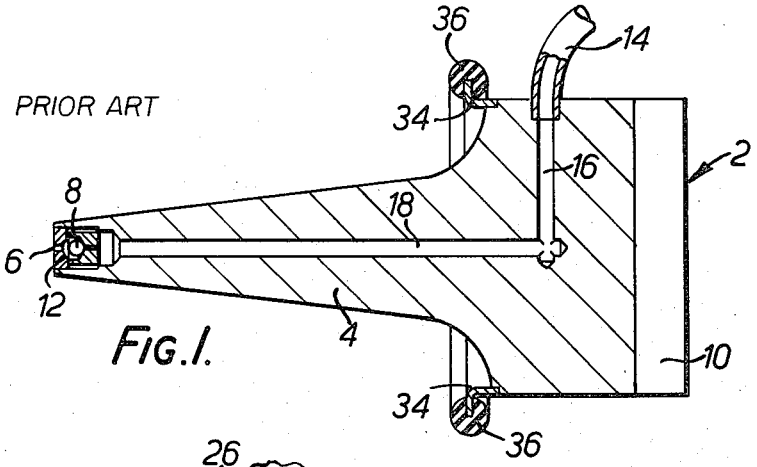
FIG. 1 is a somewhat schematic sectional view of a known injector.
Figure 2:
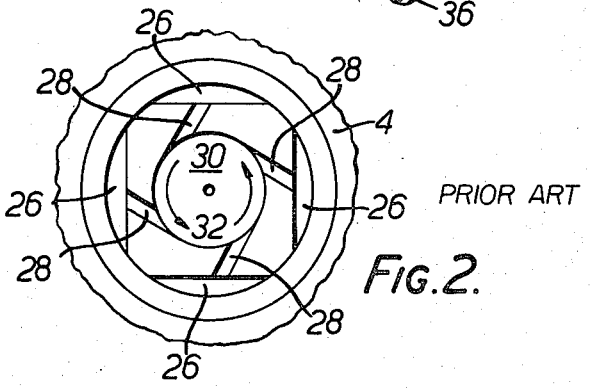
PRIOR ART FIG. 2.
FIG. 2 is a cross section through part of the injector shown in FIG. 1 and showing swirl slots.
Figure 3:
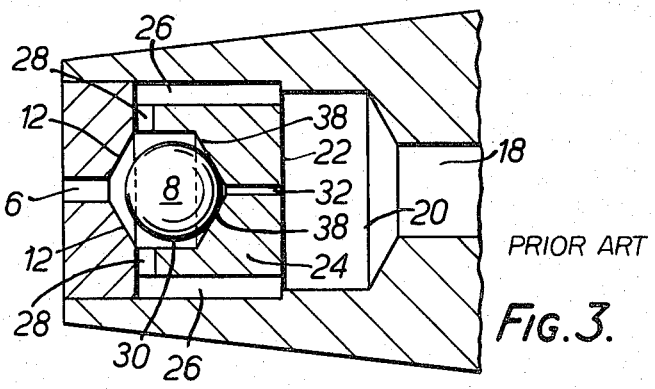
PRIOR ART FIG. 3.
FIG. 3 is a cross sectional detail showing the end part of the nozzle shown in FIG. 1.

Referring to FIGS. 1-3 there is shown a known fuel injector 2 comprising a nozzle 4, a fuel injection orifice 6 in the nozzle 4 and valve means in the form of a ball valve 8 for closing the orifice 6. The injector 2 further comprises vibratory means in the form of a piezoelectric element 10 for vibrating the nozzle 4 to cause the ball valve 8 to move away from its seat 12 wherein it closes the orifice 6.

The fuel for the injector 2 passes along a fuel inlet pipe 14 which is joined to an injector passage 16. The injector passage 16 communicates with the passage 18 which directs fuel towards the orifice 6. As shown most clearly in FIG. 3, the fuel passing along the passage 18 enters an initial chamber 20 where it mainly strikes the rear face 22 of a housing 24. The fuel in the chamber 20 passes around the outside of the housing 24 into the annular spaces 26 shown in FIG. 2 and from these spaces 26 it passes along fuel swirling slots 28. The fuel from the slots 28 passes into chamber 30 in which the ball valve 8 sits. The fuel enters the chamber 30 substantially tangentially and tends to swirl or rotate anticlockwise in the direction of the arrows shown in FIG. 2.

The rear face of the housing 24 is provided with an aperture 32. Some of the fuel striking the rear face 22 of the housing 24 passes through this aperture 32. The aperture is positioned at the place where the ball valve 8 tends to move when the piezoelectric element 10 is activated to vibrate the nozzle 4. Fuel pressure from the apparatus 32 impinges on the ball valve 8 and tends to force it towards the orifice 6 to close the orifice 6 when the piezoelectric element 10 is de-energised and the nozzle 4 stops vibrating.

As shown in FIG. 1, the nozzle 4 is provided with a flange 34 which receives a rubber "0" ring 36. The "0" ring 36 is used to mount the injector 2 in an air duct leading to an engine wherein the various cylinders of the engine are supplied with a fuel/air mixture.

In use of the injector shown in FIGS. 1-3, the housing face 38 is used to form stop means for limiting the travel of the ball 8 away from the orifice 6. If the stop means 38 is positioned a long way from the orifice 6, then the ball valve 8 can travel back to this stop means, thereby allowing relatively large quantities of fuel to be injected through the orifice 6 but then it may take a relatively long time for the ball 8 to return back to its seat 12 on the orifice 6 and this may not give sufficiently precise control over the injected fuel.

If the stop means 38 is too close to the orifice 6, then the ball 8 cannot travel very far away from the orifice 6 and can obviously be returned to the orifice 6 relatively quickly. However, with a small distance of ball travel, it may not be possible to get sufficient fuel through the orifice 6 in the time period allowed.

Referring now to FIGS. 4-8, various injectors are shown having movable stop means. Those parts of the injectors shown in FIGS. 4-8 that are similar to the injectors shown in FIGS. 4-3 have been given the same reference numerals to avoid undue repetition of description.

Figure 4:
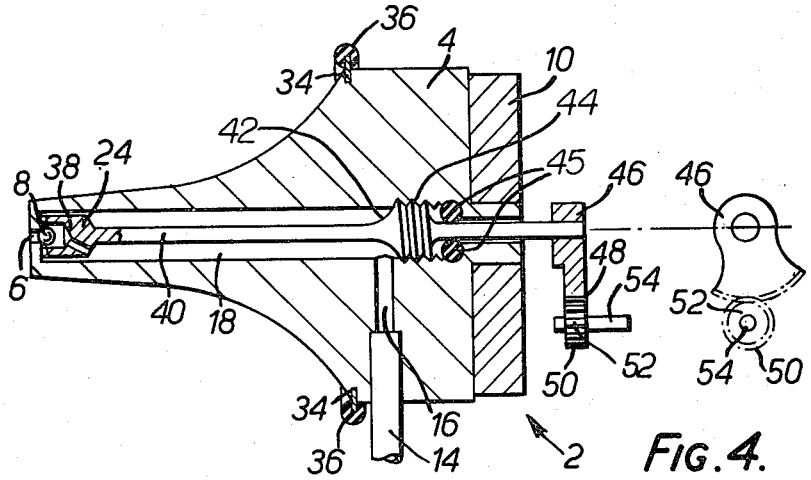
FIG. 4 is a cross section through a first injector in accordance with the invention.

Referring specifically to FIG. 4, it will be seen that the housing 24 has been joined to a rod 40. The rod 40 is provided with an enlarged portion 42 which is externally threaded as shown and which mates with a threaded portion 44 formed in the nozzle 4 of the injector 2. The rod 40 projects rearwardly completely through the nozzle 4 and the piezoelectric ceramic element 10 and is joined to an actuator device 46 which is provided with teeth 48. The teeth 48 mesh with teeth 50 on a gear 52 which is supported on a shaft 54. As the shaft is turned dependent upon some sensed engine parameter to be described hereinafter, the teeth 50 engage the teeth 48 and cause the rod 40 to rotate clockwise or anti-clockwise to screw the rod 40 into and out of the passage 18 whereby the stop means 38 is moved towards or away from the orifice 6 to give the desired spacing of the stop means 38 from the orifice 6 depending upon precise sensed engine conditions. Positioned just above the threaded portion 44 is an "0" ring fuel seal 45 which stops fuel passing backwards along the passage 18 and out through the back of the injector 2.

Figure 5:
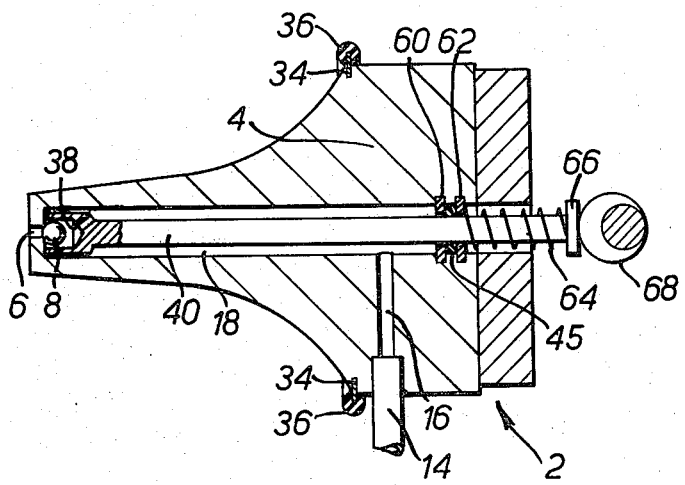
FIG. 5 is a cross section through a second injector in accordance with the invention.

Referring now to FIG. 5, the rod 40 again passes longitudinally out through the rear of the injector 2. There is again a seal 45 to stop fuel loss. In FIG. 5 the "0" ring seal 45 is housed between a pair of washers 60, 62. The washer 62 supports one end of a coil-spring 64 which is seated around the rod 40. The other end of the spring 64 abutts against a flange 66 formed integrally with the rod 40, the spring 64 biassing the rod 40 and therefore the stop means 38 away from the orifice 6 and against the pressure of a cam 68. As the cam 68 rotates, it can push the stop means 38 towards the orifice 6.

Figure 6:
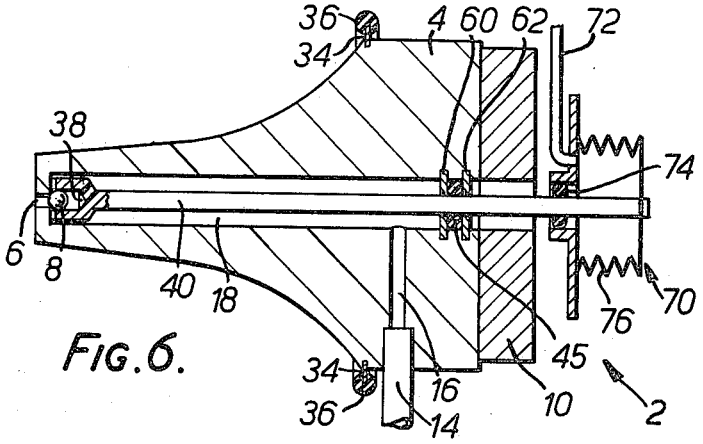
FIG. 6 is a cross section through a third injector in accordance with the invention.

The arrangement shown in FIG. 6 is very similar to that shown in FIG. 5. In FIG. 6 the cam arrangement 68 of FIG. 5 is replaced with a bellows device 70. The bellows device 70 communicates with a vacuum pipe 72 which is sensitive to various engine parameters, for example is driven from engine inlet manifold pressure. The fellows device 70 is sealed by an "0" ring seal 74 positioned around the rod 40. Obviously as the bellows 76 expand, then the stop means 38 will move away from the orifice 6.

Conversely, as the bellows 76 contract, the stop means 38 will move towards the orifice 6.

Figure 7:
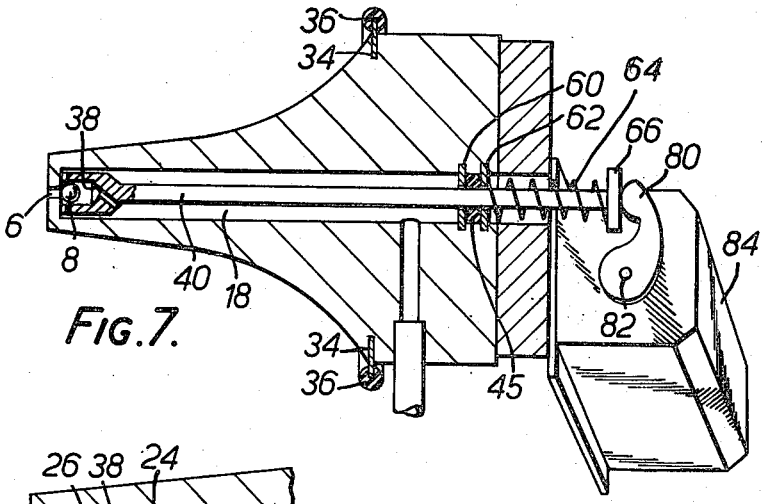
FIG. 7 is a cross section through a fourth injector in accordance with the invention.

The arrangement shown in FIG. 7 is again similar to that shown in FIG. 5. In FIG. 7, the top surface of the flange 66 is acted upon by an arm 80 which is fixed to a shaft 82. The shaft 82 is turned by a torque motor 84. The greater the current applied to the torque motor 84, then the greater will be the pressure exerted by the arm 80 on the flange 66 to cause the stop means 38 to move nearer the orifice 6. The torque motor 84 forms a convenient interface between an electrical signal that may be generated dependent upon the fuel requirements of the engine and the mechanical movement required to move the stop means 38.

Figure 8:
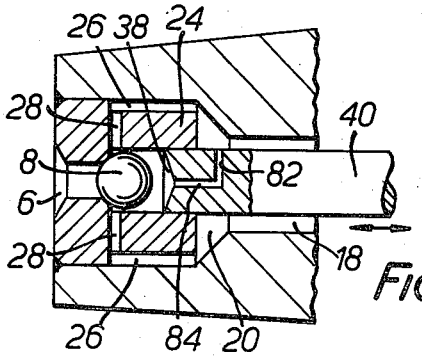
FIG. 8 is a cross section through the tip part of a fifth injector in accordance with the invention.

In the embodiments shown in FIGS. 4–7, the stop means 38 forms the rear wall of the housing 24 and the whole housing is adapted to move. In FIG. 8, the stop means 38 forms one end of the rod 40 and it will be seen that the stop means 38 is in fact slightly conically shaped to receive more uniformally the ball valve 8. Fuel passing along the passage 18 passes into the chamber 20 and then into the passages 26 and the swirler slots 28 from where the fuel can pass to the orifice 6. Fuel can also pass along the passages 82, 84 to force the ball valve 8 quickly back to the orifice 6 when vibration ceases.

Figure 9:
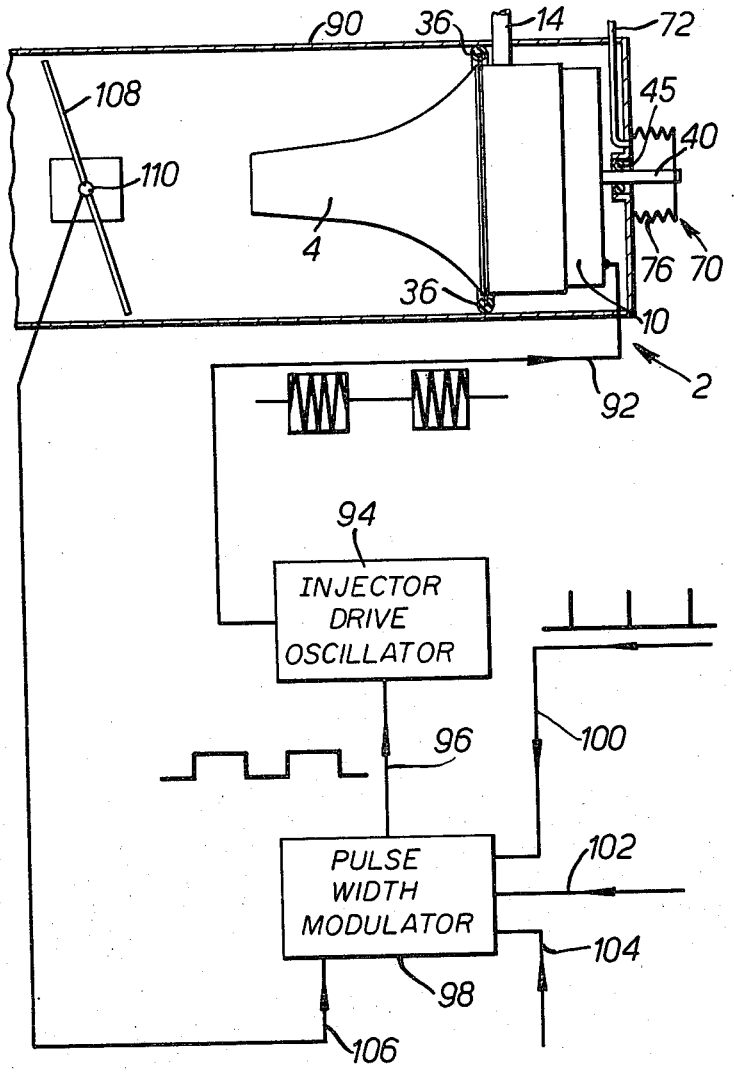
FIG. 9 shows a circuit employing the injector of FIG. 6.

Referring now to FIG. 9, the device 2 shown in FIG. 6 is shown mounted in an air duct 90. The piezoelectric ceramic device 10 is shown connected by means of a line 92 to an injector drive oscillator 94. The injector drive oscillator 94 is coupled by line 96 to a pulse width modulator 98. The pulse width modulator is itself supplied via line 100 with oscillator trigger signals which are proportional to the engine speed. The pulse width modulator 98 is also supplied via line 102 with engine temperature data and via line 104 with feed back signals from an exhaust sensor which senses the amount of oxygen in the exhaust. The output from the exhaust sensor can be used to keep the air fuel ratio to the engine constant by slight variations in the fixed pulse width. The pulse width modulator is still further supplied with appropriate information for acceleration fuel enrichment via line 106 from the change in position of a throttle 108 which pivots about a pivot point 110. The injector 2 injects fuel into the air duct 90 towards the throttle 108. The oscillator 94 is pulsed at a frequency proportional to engine speed and with a predetermined pulse width so that fuel flow increases directly proportional to engine speed. As engine load changes so does the manifold pressure and hence the ball travel and hence the fuel flow. Fuel enrichment for cold start and idle regulation may be made via adjustments made to the device 70 or again by varying the pulse width electrically via the pulse width modulator 98. Generally an adjustment will be provided so that a datum position can be set. For example, the datum position may be with the stop means in such a position as to give the fuel flow rate for correct idling of the engine at a predetermined pulse width.

It is appreciated that the embodiments of the invention described above have been given by way of example only and that modifications may be effected. Thus, for example, in FIG. 9, the fuel injection system could be provided with a different injector 2 than is shown and account could also be taken of battery volts. Also, other means of moving the rod 40 may be employed. Further, in FIG. 8, the passages 82, 84 could be omitted and the same effect achieved by having a suitable clearance between the rod 40 and the housing 24.

What we claim is:

1. An injector for injecting fuel for an engine, said injector comprising a nozzle, a fuel injection orifice disposed in the nozzle, valve obturator means for closing the orifice, vibratory means for vibrating the nozzle to cause the valve obturator means to move freely away from the orifice to allow fuel to be injected, and stop means for limiting the travel of the valve obturator means away from the orifice, the stop means being movable, said injector further comprising moving means for moving the stop means during use of the fuel injector so as to adjustably control the travel of the valve obturator means away from the orifice to that amount of travel giving the desired fuel injection rate through the orifice, said injector further comprising a housing, and wherein the valve obturator means is disposed in said housing and moves therein, the stop means being discontinuous so as to form an aperture at a position to which the valve obturator means tends to travel when it is vibrated away from the orifice, the aperture enabling fuel to pass therethrough and to force the valve obturator means away from the stop means and back to the orifice when the vibratory means ceases to vibrate the nozzle, whereby to adjustably, rapidly and precisely vary the injected fuel for the engine to suit the engine requirements at any given time.

2. The injector according to claim 1, the valve obturator means comprising a ball, the vibratory means comprising a piezoelectric device, the housing being provided with slots, and wherein, in use of the injector, fuel passes through the slots and into the housing.

3. The injector according to any one of claims 1 or 2, wherein the stop means is substantially continuously variable between minimum and maximum positions of movement thereof.

4. The injector according to any one of claims 1 or 2, further comprising a rod, wherein the stop means is substantially continuously variable between minimum and maximum positions of movement thereof, and wherein the stop means is attached to said rod, said rod passing longitudinally through the injector.

5. The injector according to any one of claims 1 or 2, further comprising a rod, wherein the stop means is substantially continuously variable between minimum and maximum positions of movement thereof, and the stop means is attached to said rod, said rod passing longitudinally through the injector, and said injector including adjustment means for adjustably enabling the rod and the stop means to be substantially continuously moved to give substantially continuous fine adjustment of the stop means.

6. The injector according to claim 5, wherein the adjustment means comprises a threaded section which projects out of the nozzle, the rod being selectively screwed in and out of the nozzle to vary the position of the stop means.

7. The injector according to claim 5, wherein the adjustment means comprises a cam, the rod being biased against the cam, the rod being adapted to be selectively moved in and out of the nozzle to vary the position of the stop means.

8. The injector according to claim 5, wherein the adjustment means comprises a bellows device, the rod being adapted to be selectively moved in and out of the nozzle to vary the position of the stop means.

9. The injector according to claim 5, wherein the adjustment means comprises a torque motor adapted to selectively move the rod in and out of the nozzle so as to vary the position of the stop means.

* * * * *